US007104331B2

(12) United States Patent
Bussear et al.

(10) Patent No.: US 7,104,331 B2
(45) Date of Patent: Sep. 12, 2006

(54) OPTICAL POSITION SENSING FOR WELL CONTROL TOOLS

(75) Inventors: Terry R. Bussear, Round Rock, TX (US); Michael A. Carmody, Houston, TX (US); Steve L. Jennings, Friendswood, TX (US); Don A. Hopmann, La Porte, TX (US); Edward J. Zisk, Jr., Kingwood, TX (US); Michael Norris, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 303 days.

(21) Appl. No.: 10/289,714

(22) Filed: Nov. 7, 2002

(65) Prior Publication Data

US 2003/0127232 A1 Jul. 10, 2003

Related U.S. Application Data

(60) Provisional application No. 60/332,478, filed on Nov. 14, 2001.

(51) Int. Cl.
*E21B 34/06* (2006.01)
*E21B 43/12* (2006.01)
*G01V 8/24* (2006.01)

(52) U.S. Cl. ..... 166/373; 166/66; 166/66.6; 340/853.8; 340/854.7; 250/227.16

(58) Field of Classification Search ..... 166/373, 166/66, 66.5–66.7, 250.1, 255.2, 250.01; 340/853.8, 854.7, 855.7, 853.1; 250/227.11, 250/227.12, 227.16, 227.18, 227.23, 231.19, 250/230, 239

See application file for complete search history.

(56) References Cited

U.S. PATENT DOCUMENTS

| | | | | | |
|---|---|---|---|---|---|
| 4,189,705 | A | * | 2/1980 | Pitts, Jr. | 340/854.7 |
| 4,547,774 | A | * | 10/1985 | Gould | 340/854.7 |
| 4,701,614 | A | * | 10/1987 | Jaeger et al. | 250/227.14 |
| 4,729,630 | A | | 3/1988 | Martinez | |
| 5,042,905 | A | | 8/1991 | Anjan et al. | |
| 5,118,931 | A | * | 6/1992 | Udd et al. | 250/227.16 |
| 5,330,136 | A | | 7/1994 | Colbaugh | |
| 5,331,152 | A | * | 7/1994 | Fenton | 250/227.11 |
| 5,363,095 | A | * | 11/1994 | Normann et al. | 340/854.7 |
| 5,774,619 | A | | 6/1998 | Bruesselbach | |
| 5,818,585 | A | * | 10/1998 | Davis et al. | 356/477 |
| 5,868,201 | A | | 2/1999 | Bussear et al. | |
| 5,893,413 | A | | 4/1999 | Lembcke et al. | |
| 5,925,879 | A | * | 7/1999 | Hay | 250/227.14 |
| 5,973,317 | A | * | 10/1999 | Hay | 250/227.14 |
| 5,975,204 | A | | 11/1999 | Tubel et al. | |

(Continued)

FOREIGN PATENT DOCUMENTS

WO WO 01/67466 9/2001

*Primary Examiner*—Kenn Thompson
(74) *Attorney, Agent, or Firm*—Madan, Mossman & Sriram, P.C.

(57) ABSTRACT

An apparatus and methods are disclosed for using optical sensors to determine the position of a movable flow control element in a well control tool. A housing has a movable element disposed within such that the element movement controls the flow through the tool. An optical sensing system senses the movement of the element. Optical sensors are employed that use Bragg grating reflections, time domain reflectometry, and line scanning techniques to determine the element position. A surface or downhole processor is used to interpret the sensor signals.

38 Claims, 9 Drawing Sheets

U.S. PATENT DOCUMENTS 6,004,639 A 12/1999 Quigley et al.
6,009,216 A 12/1999 Pruett et al.
6,233,746 B1 5/2001 Skinner
6,301,551 B1 * 10/2001 Piscalko et al. ..... 702/188
6,333,700 B1 * 12/2001 Thomeer et al. ..... 340/854.8
6,359,569 B1 * 3/2002 Beck et al. ..... 340/856.3
2001/0013412 A1 8/2001 Tubel
2001/0020675 A1 9/2001 Tubel et al.
2004/0135075 A1 * 7/2004 Hay et al. ..... 250/227.21
2004/0163809 A1 * 8/2004 Mayeu et al. ..... 166/255.1
2004/0194958 A1 * 10/2004 Mayeu et al. ..... 166/255.1

* cited by examiner

OPTICAL POSITION SENSING FOR WELL CONTROL TOOLS

CROSS-REFERENCE TO RELATED APPLICATION

This application claims the priority of U.S. Provisional Application No. 60/332,478 filed on Nov. 14, 2001.

BACKGROUND OF THE INVENTION

1. Field of the Invention

This invention relates generally to a method for the control of oil and gas production wells. More particularly, it relates to an optical position sensor system for determining the position of movable elements in well production equipment.

2. Description of the Related Art

The control of oil and gas production wells constitutes an on-going concern of the petroleum industry due, in part, to the enormous monetary expense involved as well as the risks associated with environmental and safety issues.

Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well. Flow control devices such as sliding sleeve valves, packers, downhole safety valves, downhole chokes, and downhole tool stop systems are commonly used to control flow between the production tubing and the casing annulus. Such devices are used for zonal isolation, selective production, flow shut-off, commingling production, and transient testing.

These tools are typically actuated by hydraulic systems or electric motors driving a member axially with respect to a tool housing. Hydraulic actuation can be implemented with a shifting tool lowered into the tool on a wireline or by running hydraulic lines from the surface to the downhole tool. Electric motor driven actuators may be used in intelligent completion systems controlled from the surface or using downhole controllers.

The surface controllers are often hardwired to downhole sensors which transmit information to the surface such as pressure, temperature and flow. With multiple production zones intermingled in the single well bore, it is difficult to determine the operation and performance of individual downhole tools from surface measurements alone. It is also desirable to know the position of the movable members, such as the sliding sleeve in a sliding sleeve valve, in order to better control the flow from various zones. Originally, sliding sleeves were actuated to either a fully open or fully closed position. Surface controlled hydraulic sliding sleeves such as Baker Oil Tools Product Family H81134 provides variable position control of the sleeve which allows for continuous flow control of the zone of interest. In order to efficiently utilize this control capability, a sensor system is needed to determine the position of the sleeve. Position data is then processed at the surface by the computerized control system and is used for control of the production well. Similar position data will enhance the efficient flow control of the other downhole tools mentioned. In addition, for critical tools, such as downhole safety valves, indication of the position, or setting, of the valve is desired to ensure that the valve is operating properly.

Thus there is a need for a position sensing system which can monitor the operating configuration of downhole tools by measuring the position of a movable member over a large displacement range.

SUMMARY OF THE INVENTION

The methods and apparatus of the present invention overcome the foregoing disadvantages of the prior art by providing a reliable method of sensing the position of a movable member in a downhole tool including, but not limited to, a sliding sleeve production valve, a safety valve, and a downhole choke.

The present invention contemplates an apparatus for and method of using optical position sensors to determine the position of a movable flow control member in a downhole flow control tool such as a sliding sleeve, production valve safety valve, or the like.

In one preferred embodiment, this invention provides a system for controlling a downhole flow, comprising a flow control device in a tubing string in a well. The flow control device has a first member engaged with the tubing string and a second member moveable with respect to the first member, and acting cooperatively with the first member for controlling the downhole flow through the flow control device. An optical position sensing system acts cooperatively with the first member and the second member for detecting a position of the second member relative to the first member and generating at least one signal related thereto. A controller receives the at least one signal and determines, according to programmed instructions, the position of the second member relative to the first member and controls the downhole flow in response thereto.

A method is provided for determining the position of a movable flow control member in a well flow control tool, comprising sensing the position of the flow control member using an optical position sensing system and generating a signal related to the flow control member position. The signal is transmitted to a controller. The position of the flow control member is determined according to programmed instructions.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

As is known, a given well may be divided into a plurality of separate zones which are required to isolate specific areas of a well for purposes of producing selected fluids, preventing blowouts and preventing water intake. A particularly significant contemporary feature of well production is the drilling and completion of lateral or branch wells which extend from a particular primary wellbore. These lateral or branch wells can be completed such that each lateral well constitutes a separable zone and can be isolated for selected production.

Figure 1:
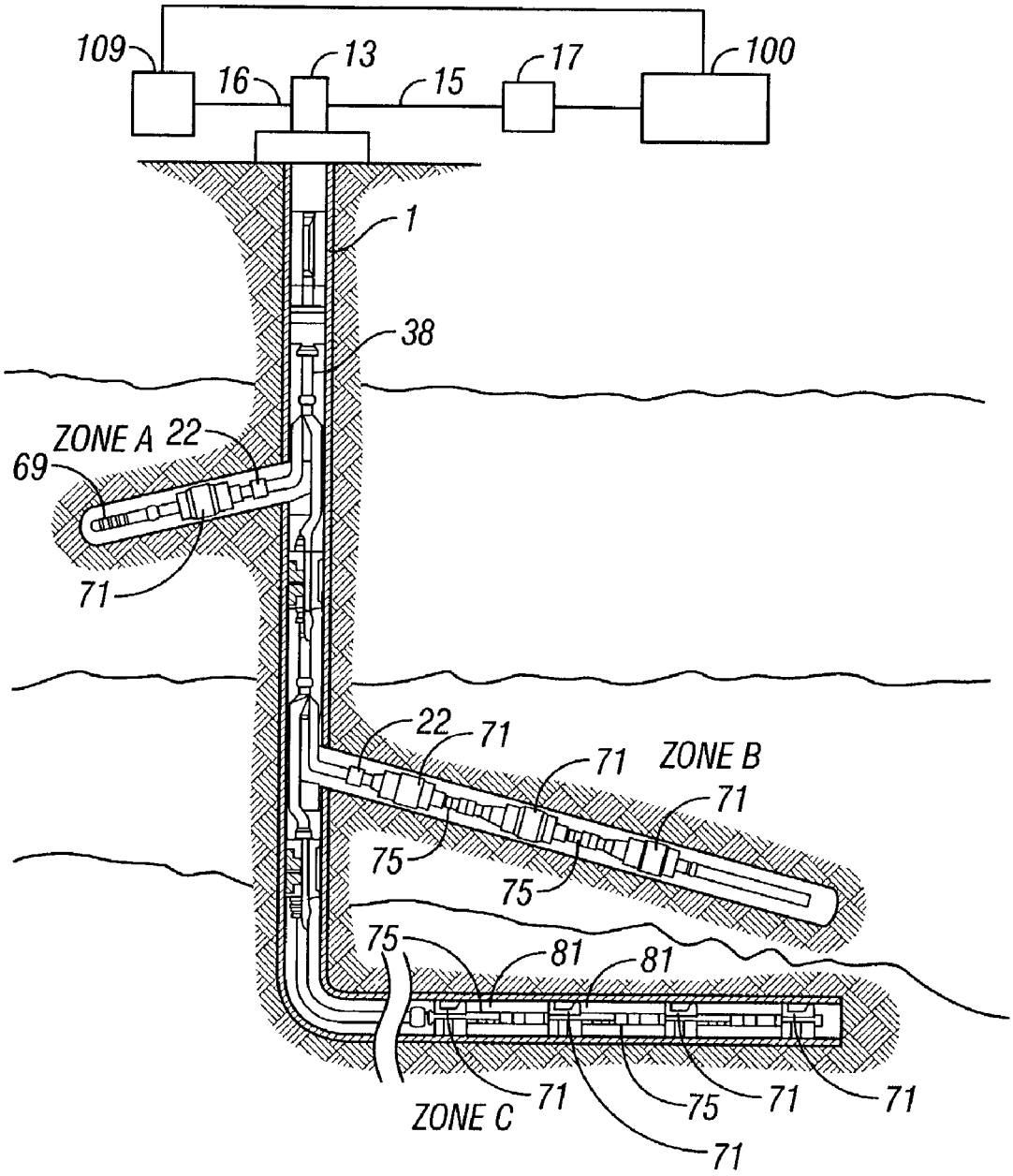
FIG. 1 is a diagrammatic view depicting a multizone completion with an optical position sensing system according to one embodiment of the present invention.

With reference to FIG. 1, well 1 includes three zones, namely zone A, zone B and zone C. Each of zones A, B and C have been completed in a known manner.

In zone A, a slotted liner completion is shown at 69 associated with a packer 71. In zone B, an open hole completion is shown with a series of packers 71 and sliding sleeve 75, also called a sliding sleeve valve. In zone C, a cased hole completion is shown again with the series of packers 71, sliding sleeve 75, and perforating tools 81. The packers 71 seal off the annulus between the wellbores and the sliding sleeve 75 thereby constraining formation fluid to flow only through an open sliding sleeve 75. The completion string 38 is connected at the surface to wellhead 13.

In a preferred embodiment, hydraulic fluid is fed to each sliding sleeve 75 through a hydraulic tube bundle(not shown) which runs down the annulus between the wellbore 1 and the tubing string 38. Each of the packers 71 is adapted to pass the hydraulic lines while maintaining a fluid seal. Likewise, at least one optical fiber 15 is run in the annulus to each of the sliding sleeves 75. The optical fibers may be run in a separate bundle or they may be included in the bundle with the hydraulic lines. The optical fiber 15 is terminated, at the surface in an optical system 17 which contains the optical source and analysis equipment as will be described. In one preferred embodiment, the optical system 17 comprises a light source and a spectral analyzer (see FIGS. 4–7). In another preferred embodiment, the optical system 17 comprises an optical time domain reflectometer (see FIGS. 8–9). The optical system 17 outputs a conditioned signal to a controller 100 which uses the information to control the well. The controller 100 contains a microprocessor and circuitry to interface with the optical system 17 and to control the hydraulic system 109 according to programmed instructions for positioning the sliding sleeves and other flow control devices as desired in the multiple production zones to achieve the desired flows. Such other devices include, but are not limited to, downhole safety valves, downhole chokes, and downhole tool stop systems and are described in U.S. Pat. No. 5,868,201, assigned to the assignee of this application, and is hereby incorporated herein by reference.

It will be appreciated by those skilled in the art that, in another preferred embodiment, an intelligent well control system controls the flow control devices such as sliding sleeve 75. In such a system, the flow control devices are powered by a downhole electromechanical driver (not shown) and the optical system 17 may be contained in a downhole controller (not shown). Such a downhole control system is described in U.S. Pat. No. 5,975,204, assigned to the assignee of this application, and is hereby incorporated herein by reference.

Figure 2:
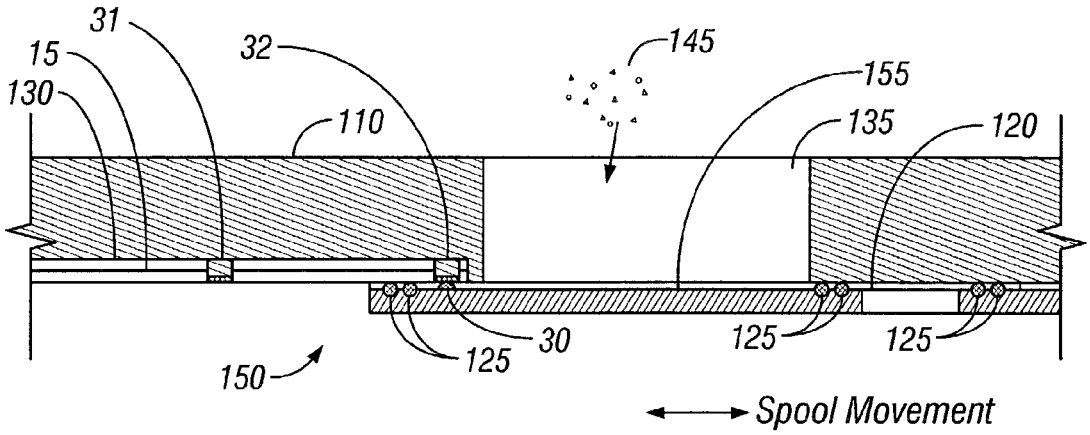
FIG. 2 is a diagrammatic view of a section of a sliding sleeve valve with fiber optic sensors according to one embodiment of the present invention.
Figure 3A:
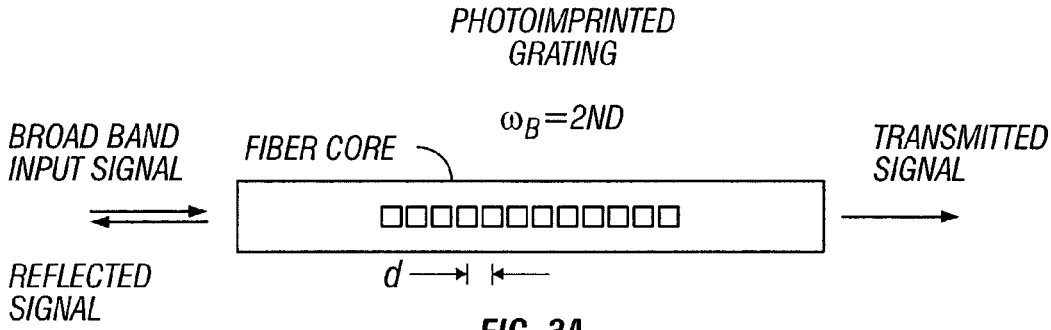
FIGS. 3*a–d* is a schematic diagram of a Bragg grating disposed in an optical fiber according to one embodiment of the present invention.
Figures 3B, 3C, 3D:
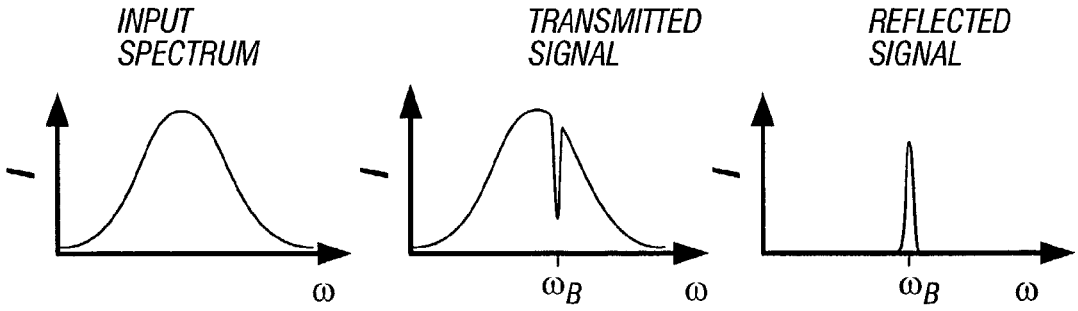

FIG. 2 is a schematic section of sliding sleeve valve assembly, also commonly referred to as a sliding sleeve, 75. Housing 110 is attached on an upper end to the production string (not shown). As previously indicated in FIG. 1, the production string is sealed to the wellbore above and below the sliding sleeve by packers 71. In this preferred embodiment, housing 110 has multiple slots 135 arranged around a section of the housing 110. A flow control member, or sliding spool, 155 is disposed inside of housing 110 and has multiple slots 120. Spool 155 has elastomeric seals 125 arranged to seal off flow of formation fluids 145 when spool 155 is in the shown closed position. Spool 155 is driven by a surface controlled hydraulic powered shifting mechanism (not shown). Such hydraulic shifting devices are common in downhole tools and are not discussed further. Alternatively, spool 155 may be driven by an electromechanical actuator (not shown).

Housing 110 has an internal longitudinal groove 130. Disposed in longitudinal slot 130 is optical fiber 15 and microbend elements 31 and 32. The optical fiber 15 has Bragg gratings written onto the fiber 15 at positions of interest. The operation of the Bragg gratings and microbend elements is discussed below. The optical fiber 15 and microbend elements 31,32 are potted in groove 130 using a suitable elastomeric or epoxy material. The potted groove is blended with the internal diameter of housing 110 such that seals 125 effect a fluid seal with the housing 110. Microbend elements 31 and 32 induce a microbend in the optical fiber 15 when the elements are actuated. This microbend creates a optical loss at the point of the microbend which can be detected using optical techniques as will be discussed below in more detail. Microbend elements can be mechanically and magnetically actuated devices. Mechanical microbend elements are known in the art of fiber optic sensors and will not be discussed further. A type of magnetically actuated microbend element is discussed later. The elements 31,32 are actuated by engagement with an external member, also termed an actuator, 30 attached at a predetermined location on the periphery of spool 155. External member 30 may be a continuous annular rib or, alternatively, a button type attachment to spool 155. In a preferred embodiment, the external member 30 engages only one microbend element at a time. In another preferred embodiment, external member 30 extends longitudinally along spool 155 such that external member 30 continues to engage each previously engaged microbend element as the spool 155 moves from the closed position to the open position. It will be appreciated that as many microbend elements may be disposed along the optical fiber 15 as there are positions of interest of spool 155.

In another preferred embodiment, optical time domain reflection techniques are used to determine the location of the microbend. Optical time domain reflection techniques are discussed below.

Figure 4:
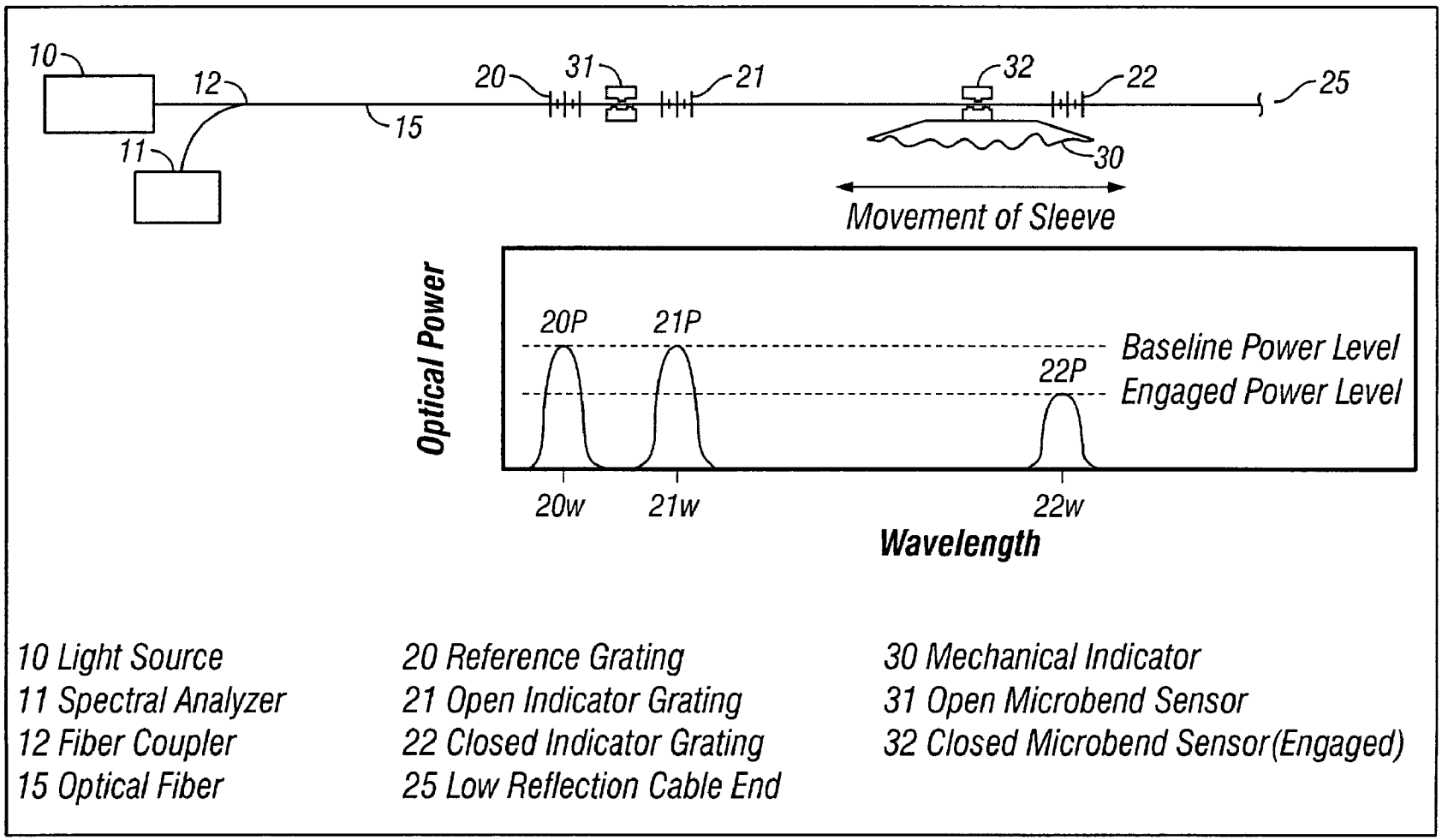
FIG. 4 is a schematic diagram of a sliding sleeve valve two position fiber optic position sensor using Bragg gratings according to one embodiment of the present invention.

Referring to FIGS. 2 and 4 an optical fiber 15 is embedded in the housing 110 with microbend elements 31 and 32 located at positions along the fiber 15 corresponding to positions of interest of the spool 155. A Bragg grating is written into the fiber 15 next to each of the microbend elements 31 and 32 using techniques known in the art. A person skilled in the art would appreciate how the optical fiber Bragg grating is used as a sensor element. Each fiber Bragg grating is a narrowband reflection filter permanently imparted into the optical fiber. The filter is created by imparting gratings formed by a periodic modulation of the refractive index of the fiber core. The techniques for modulating the index are known in the art. The reflected wavelength is determined by the internal spacing of the grating as seen generally in FIGS. 3*a*–3*d*. Light is partially reflected at each grating, with maximum reflection when each partial reflection is in phase with its neighbors. This occurs at the Bragg wavelength, $W_b$=2nd, where n is the average refractive index of the grating and d is the grating spacing. In this invention, each grating has a different predetermined spacing and therefore each grating will reflect a different predetermined wavelength of light. Such gratings are commercially available. By using a different predetermined wavelength for each grating, the reflected light can be spectrally analyzed to determine the wavelength and amplitude of the reflected signal from each grating along the optical fiber.

In general, the microbend elements are actuated by an external member, which may be an annular band or alternatively a button, on the sliding spool 155 as it passes each microbend element. As the microbend element is actuated it imparts a bend in the optical fiber 15, creating an optical power loss through the optical fiber 15 at the point of the bend. By analyzing the amplitude and wavelength of the reflected light from the various gratings, the position of the actuated microbend element can be determined.

FIGS. 2 and 4 shows a preferred embodiment of a two position sensor for determining if a sliding sleeve is opened or closed. An optical fiber 15 is disposed in a tubular housing 110 containing sliding spool 155 and external member 30. Microbend element 31 is located along the optical fiber 15 and is positioned to indicate one limit of the travel of spool 155 when engaged by external member 30. External member 30 is sized to engage only one microbend sensor at a time. Similarly, microbend element 32 is located to indicate the other limit of the travel of spool 155.

Bragg gratings 20 and 21 are written onto the optical fiber 15 proximate microbend element 31. Bragg grating 20 is located between light source 10 and microbend element 31 and acts as a baseline reference for indicating the baseline optical power reflection without the effects of the microbend elements. Grating 21 is written on the optical fiber 15 just downstream of the microbend element 31. As used herein, upstream refers to the direction towards the light source 10, and downstream refers to the direction away from the light source 10. Grating 22 is located proximate to and downstream of microbend element 32. The fiber end 25 of optical fiber 15 is terminated in an anti-reflective manner so as to prevent interference with the reflective wavelengths from the Bragg gratings. The fiber end 25 may be cleaved at an angle so that the end face is not perpendicular to the fiber axis. Alternatively, the fiber end 25 may be coated with a material that matches the index of refraction of the fiber, thus permitting light to exit the fiber without back reflection. Light reflected from the gratings travels back toward the light source 10 and is input to spectral analyzer 11 by fiber coupler 12. Spectral analyzer 11 determines the reflected optical power and wavelength of the reflected signals.

Still referring to FIG. 4, it can be seen that external member 30 is engaged with microbend element 32 thereby creating a bend in the optical fiber 15 at that location. The bend at the location of element 32 causes a loss in optical power transmitted downstream of element 32. In operation light source 10 transmits a broadband light signal down optical fiber 15. The signal is reflected by grating 20 at wavelength 20*w* and power level 20*p* thereby establishing a baseline for comparison with the downstream grating reflections. Since microbend element 31 is not actuated the light travels relatively undiminished to grating 21 where wavelength 21*w* is reflected at power level 21*p*. In FIG. 4, the power levels 20*p* and 21*p* are essentially equal. The light signal continues down the optical fiber 15 and encounters actuated microbend element 32 which causes an attenuated light signal to be transmitted downstream to grating 22. Grating 22 reflects wavelength 22*w* at a diminished power level 22*p*, relative to power levels 20*p* and 21*p*. The reflected signals are analyzed by spectral analyzer 11 and the resulting signals are shown in FIG. 4 where the engaged power level 22*p* from grating 22 is measurably less than the power levels 20*p* and 21*p* from gratings 20 and 21 respectively. The relative power levels and wavelengths are sent to a processing unit 100 which determines according to programmed instructions and the predetermined locations of the microbend elements and the gratings, the spool 155 position.

Figure 5:
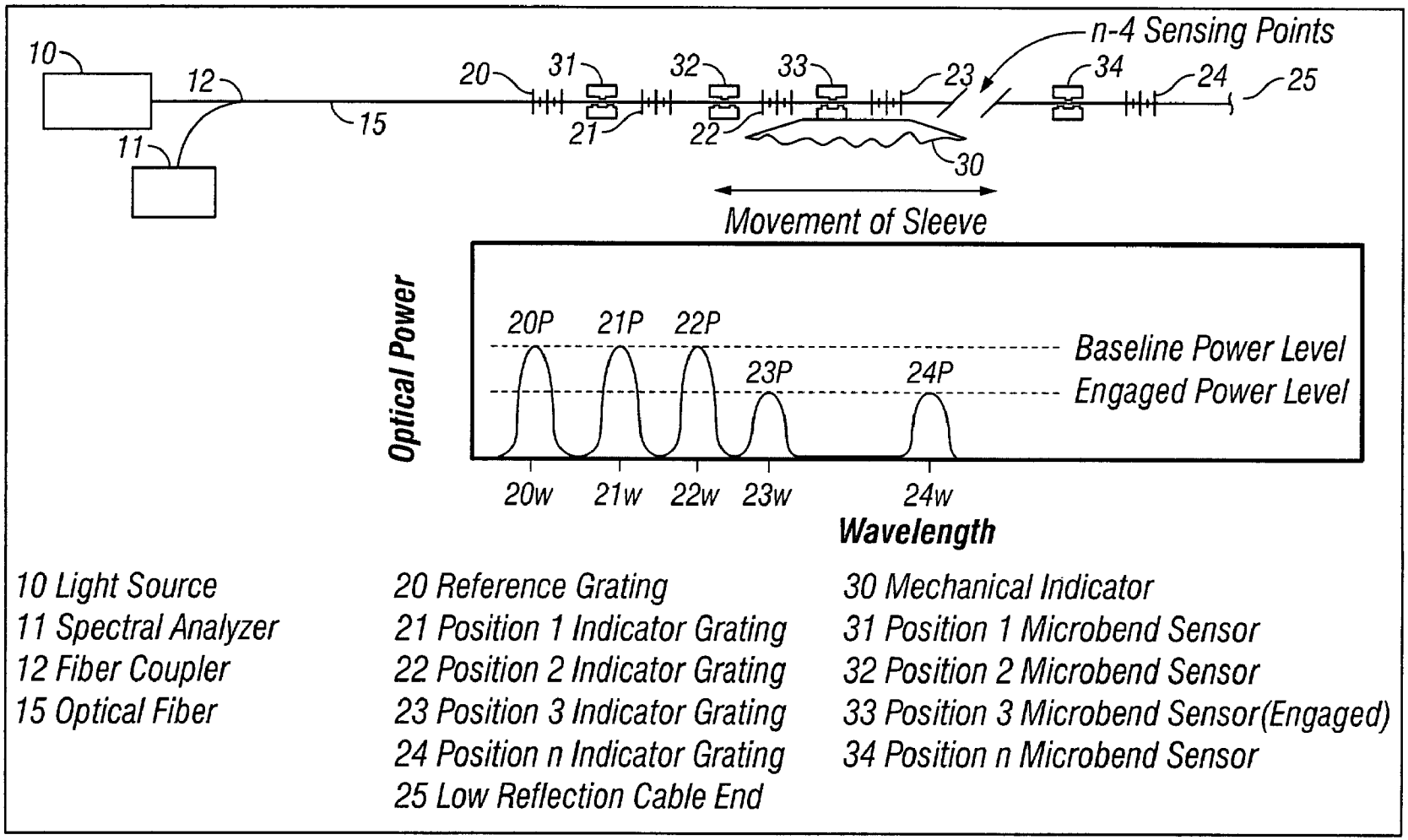
FIG. 5 is a schematic diagram of a sliding sleeve valve multiple position fiber optic position sensor using Bragg gratings according to one embodiment of the present invention.

FIG. 5 shows a preferred embodiment for determining multiple positions of a sliding spool. This embodiment is similar to the two position system. As shown in FIG. 5, microbend elements 31, 32, 33 and 34 with associated gratings 21, 22, 23 and 24 respectively, each with a unique predetermined wavelength 21*w*–24*w* are disposed at predetermined positions of interest along optical fiber 15. Note that a greater or fewer number of pairs of microbend elements and gratings could be located along the optical fiber 15.

Bragg grating 20 is placed upstream of element 31 and serves as a baseline reference of reflected power. As shown in FIG. 5, external member 30 on sliding spool 155, is engaged with microbend element 33 thereby bending optical fiber 15 at that location. As previously indicated, the bending of optical fiber 15 by microbend element 33 causes a loss of optical power to be transmitted downstream of element 33. Therefore, as shown in FIG. 5, the optical power 23*p* and 24*p* reflected from the gratings 23 and 24, which are downstream of element 33 are measurably lower than the power levels 20*p*, 21*p* and 22*p* measured upstream of element 33. The reflected signals are analyzed with spectral analyzer 11 and the resulting power levels at the predetermined wavelengths are sent to a processing unit which determines the location of the sliding spool 155 from the predetermined locations of the microbend elements and gratings.

Figure 6:
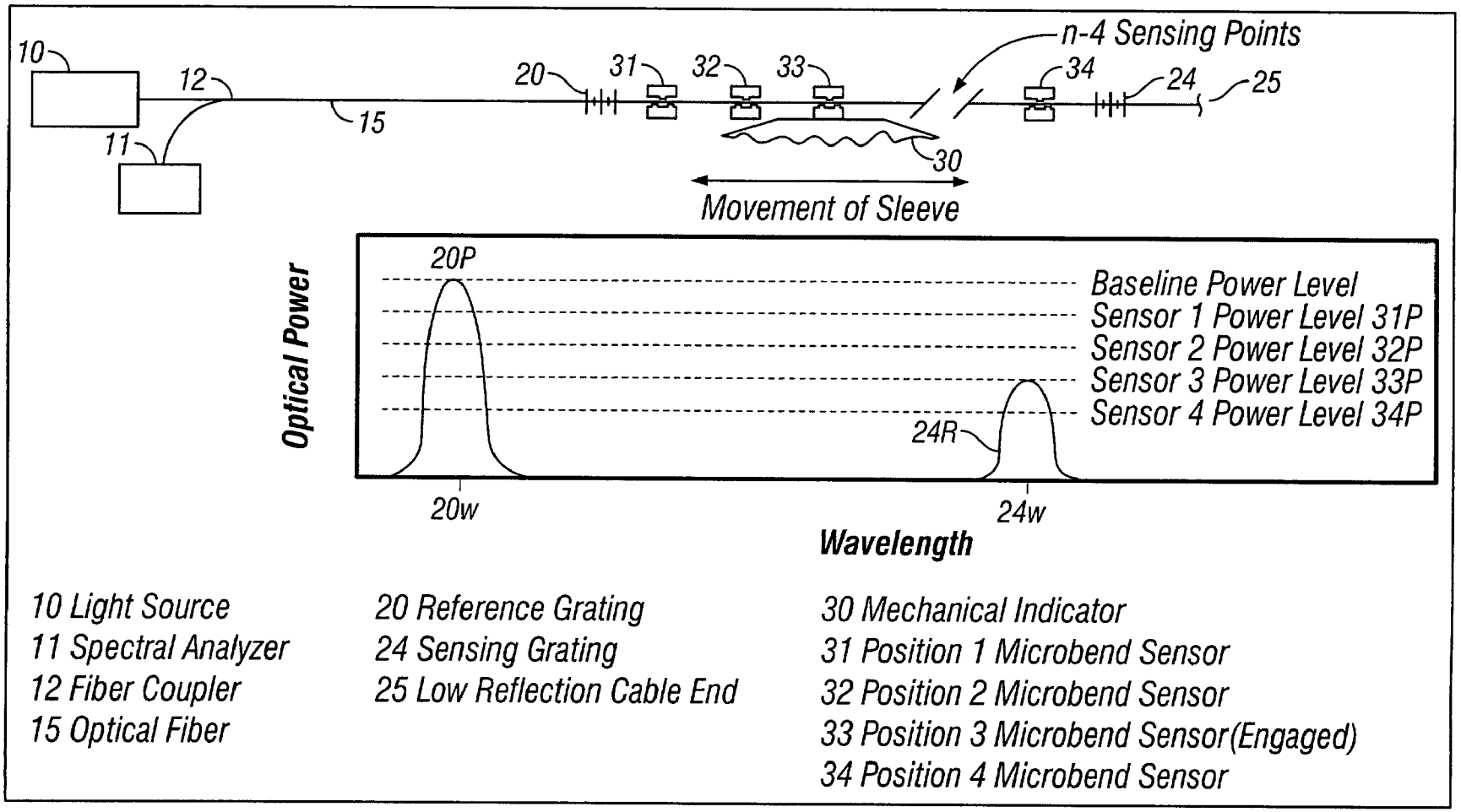
FIG. 6 is a schematic diagram of an alternative sliding sleeve valve multiple position fiber optic position sensor using Bragg gratings according to one embodiment of the present invention.

FIG. 6 shows another preferred embodiment for determining multiple positions of a sliding sleeve. In this preferred embodiment, multiple microbend elements 31, 32, 33 and 34 are disposed at predetermined positions of interest along optical fiber 15. Each microbend element is adapted to induce a unique microbend in optical fiber 15. Each microbend element, therefore, has associated with it a unique optical power loss. Reference grating 20 with wavelength 20*w* is located along the optical fiber 15 upstream of the microbend elements. Grating 24 is located downstream of the microbend elements.

As shown in FIG. 6, the sliding spool external member 30 is engaged with microbend element 33. Element 33 imposes a unique microbend on optical fiber 15 resulting in a uniquely measurable power transmission which is detected by measuring the reflected power from grating 24 at wavelength 24*w* as shown by reflected signal 24*r* in FIG. 6. The amplitude of signal 24*r* corresponds to the unique characteristic transmission of element 33. Note that while the unique power levels shown for each microbend element are monotonically decreasing, this is not a requirement. It is only necessary that each microbend element have a transmission loss that is measurably unique.

Figure 7:
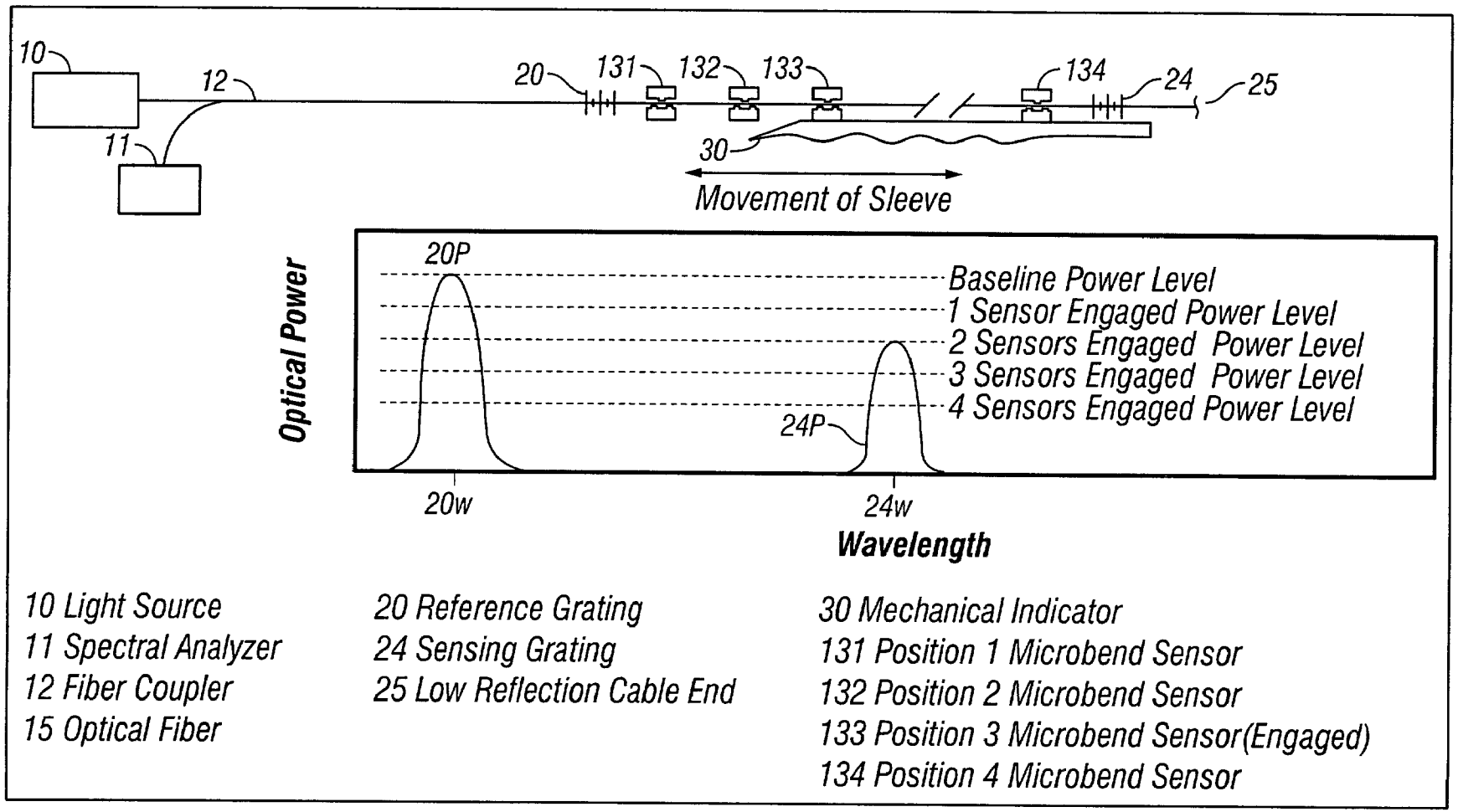
FIG. 7 is a schematic diagram of a second alternative sliding sleeve valve multiple position fiber optic position sensor using Bragg gratings according to one embodiment of the present invention.

FIG. 7 shows yet another preferred embodiment for determining multiple positions of a sliding sleeve. Here, each of microbend elements 131, 132, 133 and 134 creates a uniform optical loss in optical fiber 15 when actuated by spool external member 30. Spool external member 30 is adapted to continue to engage each microbend element after the sleeve has passed said element. As shown in FIG. 7, sleeve external member 30 is engaging microbend element 133 and continues to engage element 134. Each engaged element uniformly decreases the optical power transmitted down the optical fiber 15 and hence decreases the optical power reflected by grating 24 and sensed by analyzer 11. The power level detected is transmitted to processor 100 which determines the sleeve location from the predetermined positions of the microbend elements 131, 132, 133, 134 and predetermined uniform loss through each actuated microbend element. It will be appreciated that a greater or fewer number of microbend elements may be employed depending on the number of sliding spool positions of interest to be detected.

Figure 8:
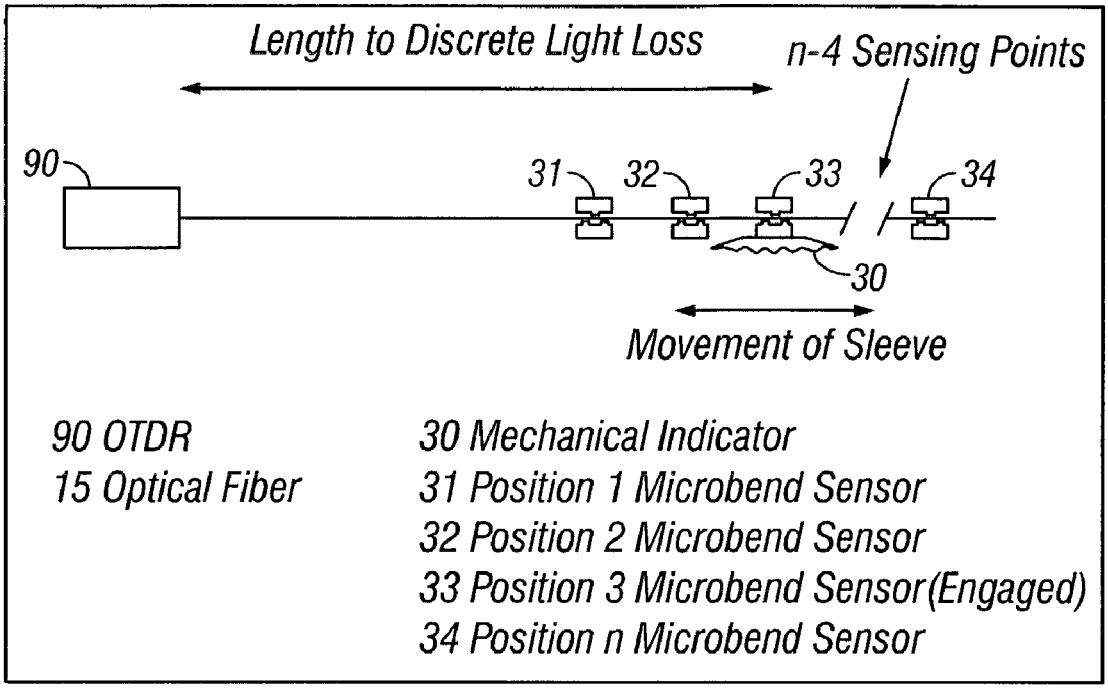
FIG. 8 is a schematic diagram of a sliding sleeve valve multiple position fiber optic position sensor using optical time domain reflection techniques according to one embodiment of the present invention.

FIG. 8 shows a preferred embodiment of a fiber optic sliding sleeve position indicator using optical time domain reflection techniques to measure the time of flight of an optical signal as it is reflected from a microbend in an optical fiber. The physical arrangement is similar to the previously described position indicators, however, no Bragg gratings are used to characterize the reflected signal. As shown, microbend elements 31, 32, 33, 34 are disposed along optical fiber 15 at predetermined locations of interest, with element 33 engaged and actuated by spool external member 30. Element 33 creates a microbend in optical fiber 15. As is known in the art, the microbend in optical fiber 15 will generate a reflection point for light traveling along optical fiber 15. Optical time domain reflectometer (OTDR) 90 generates a light signal which travels down the optical fiber 15 and a portion of the light signal is reflected by the microbend created at element 33. The reflected signal is sensed at OTDR 90 and the time for the signal to reach the microbend and return is measured. This time of flight and the predetermined optical properties of optical fiber 15 are input to processor 100 which determines according to programmed instructions which microbend element has been actuated. Optical time domain reflectometers are commercially available and are used extensively in determining the position of anomalies in fiber optic transmission lines.

Figure 9:
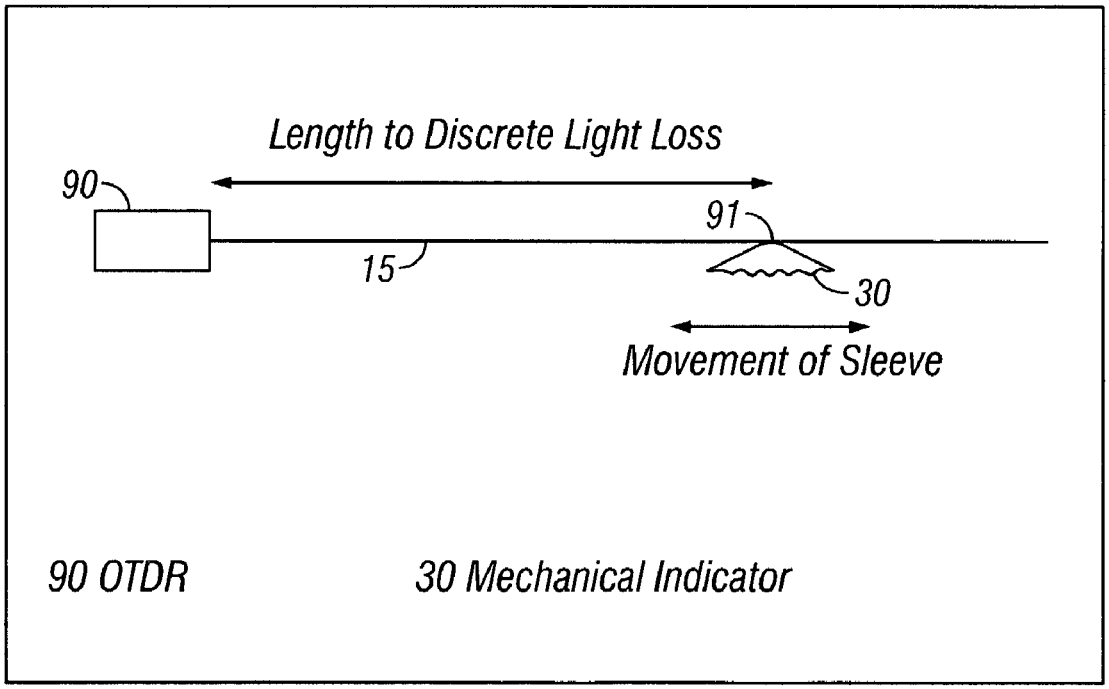
FIG. 9 is a schematic diagram of an alternative sliding sleeve valve multiple position fiber optic position sensor using optical time domain reflection techniques according to one embodiment of the present invention.

FIG. 9 shows another preferred embodiment using a fiber optic technique to determine the position of a sliding sleeve. Optical fiber 15 is directly engaged by spool external member 30 which creates an optical microbend 91 in optical fiber 15. The microbend 91 causes a discrete reflection of light traveling down the optical fiber 15. OTDR 90 generates a light signal which travels down optical fiber 15 and is partially reflected at microbend 91. The reflected signal is detected by OTDR 90 and the time of flight to the reflection point at microbend 91 and back is determined. The time of flight and the predetermined optical properties of optical fiber 15 are input to processor 100 which determines the location of the microbend 91 along the optical fiber 15.

Figure 10:
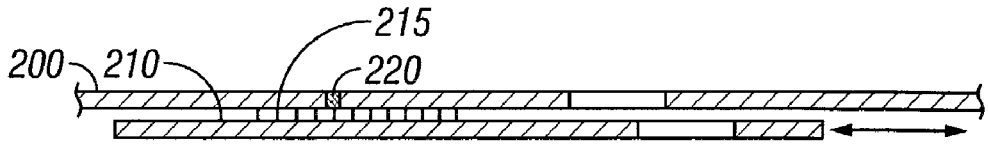
FIG. 10 is a schematic diagram of a well control tool with an optical senor system, according to one embodiment of the present invention.
Figure 11:
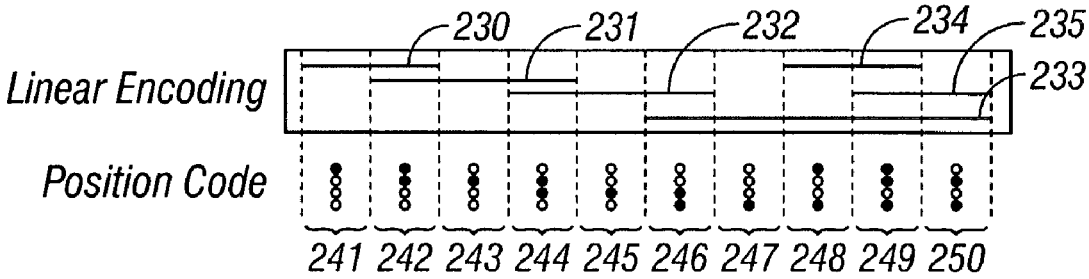
FIG. 11 is a schematic of a preferred marking pattern for determining position according to one embodiment of the present invention.

FIG. 10 shows another preferred embodiment using an optical encoding technique to determine the position of a sliding sleeve valve. Encoding reader 220 is disposed in housing 200 such that it scans the outer surface of flow control member, or spool, 210 as spool 210 moves axially relative to housing 200. A predetermined pattern of position encoding marks 215 are disposed on the outer surface of spool 210 and are detected by reader 220 as the spool 210 moves. Signals from reader 220 are transmitted to the surface processor 100 for determining the spool 210 position. FIG. 11 shows one preferred pattern of linear encoding marks 230–235 axially disposed on the outer surface of spool 210. Marks 230–235 may be disposed on the outer surface of spool 210 by machining techniques, photo-etching techniques, or photo-printing techniques common in the manufacturing arts. Marks 230–235 may be protrusions from the outer surface of spool 210, depressions in the surface, or essentially even with the surface. Marks 230–235 may be coated with reflective materials or paints to enhance detection by reader 220. The marks 230–235 are positioned to pass through the scanning view of reader 220 as spool 210 moves axially. The overlapping of the marks 230–235 result in the discrete position readings 241–150 as indicated in FIG. 11. It will be appreciated that different numbers and overlapping patterns of marks can result in different numbers of discrete positions. The position of the spool 210 can be determined to within the resolution of the encoding pattern used.

Figure 12:
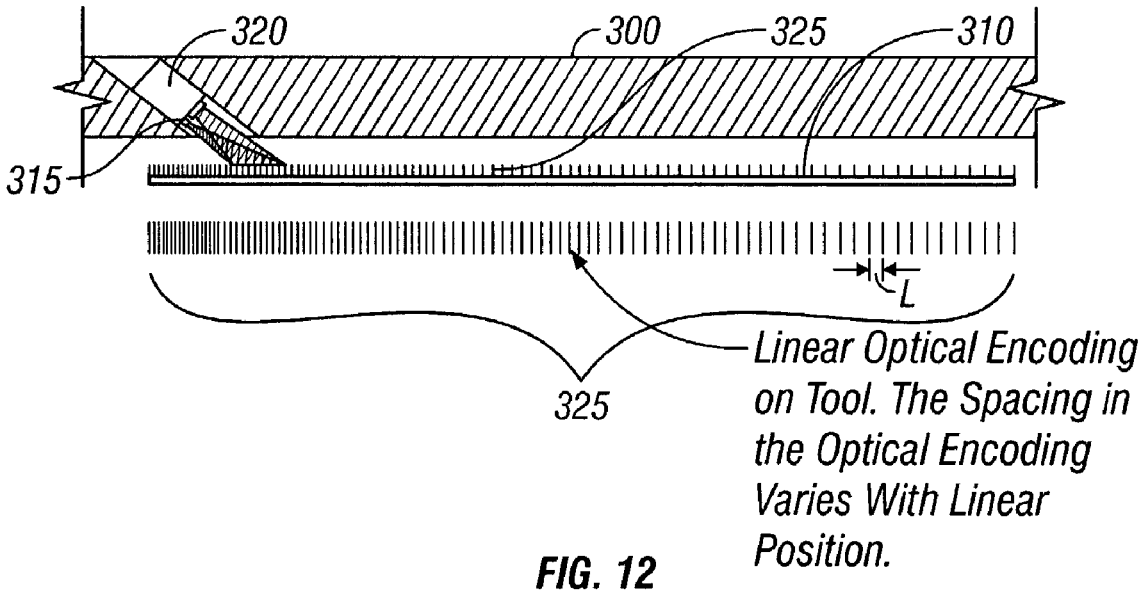
FIG. 12 is a schematic of an preferred grating pattern according to one embodiment of the present invention; and, FIG. 13 is a schematic showing an optical-magnetic technique fiber optic position sensing technique according to one embodiment of the present invention.

FIG. 12 shows another preferred embodiment using an optical encoding technique to determine the position of a sliding sleeve valve. An optical grating 325 is disposed on the outer surface of spool 310. The spacing "L" between adjacent grating lines changes with axial location along the spool 310. An optical source 315 illuminates the gratings 325 and the reflected pattern is read by optical detector 320 mounted in the wall of housing 300. Optical source 315 and optical detector 320 may be integrated into a single module or alternatively may be separate modules. The variation in spacing L may be continuous or, alternatively, discrete sections (not shown) of spool 310 may each have a unique spacing (not shown).

Figure 13:
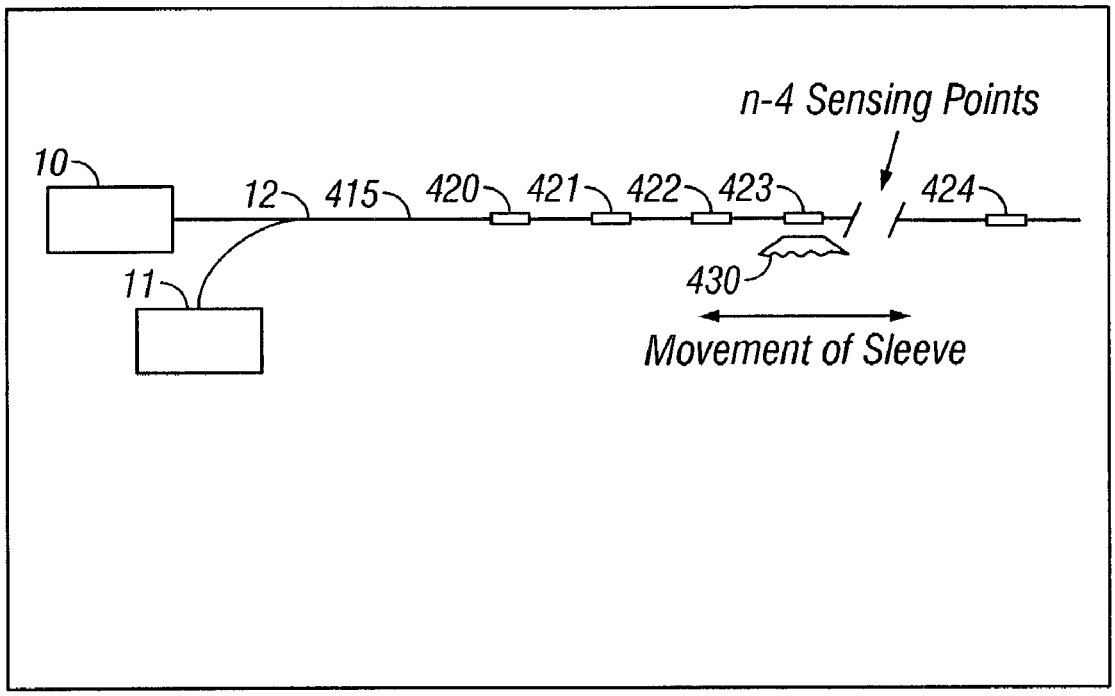

FIG. 13 shows another preferred embodiment using an optical-magnetic technique to determine the position of a sliding sleeve valve. Using a physical configuration as shown in FIG. 2, magnetic responsive elements 420, 421, 422, 423, and 424 are located at predetermined positions along and are engaged with optical fiber 415. A magnet 430, such as a rare-earth magnet is mounted on sliding sleeve spool 155. Magnetic responsive microbend elements 420–424 are constructed of magneto-strictive materials such that the elements 420–424 create a microbend in optical fiber 415 when an element is juxtaposed with magnet 430. In one embodiment, each of the elements 420–424 is sized to create a unique microbend and hence a unique optical reflection from each of the elements 420–424 which is detected by measuring the reflected power signal. Alternatively, the elements 420–424 may be adapted to provide an essentially uniform optical reflection from each element. The reflected signal is transmitted to processor 100 which determines the spool location from the predetermined position of the elements 420–424 and the unique reflection associated with each element. The magnetic responsive elements 420–424 can be used as microbend elements for all of the techniques described in FIGS. 4–9 using Bragg gratings or time domain reflectometry.

It will be appreciated that the described fiber optic position sensing techniques may be incorporated in other downhole tools where position or proximity sensors are required to indicate the axial motion of one member relative to a second member where the axial motion enables the control of the well. These tools may include, but are not limited to, inflation/deflation tools for packers, a remotely actuated tool stop, a remotely actuated fluid/gas control device, a downhole safety valve, and a variable choke actuator. These tools are described in U.S. Pat. No. 5,868,201 previously incorporated herein by reference.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

What is claimed is:

1. A system for controlling a downhole flow, comprising;

a. a flow control device in a tubing string in a well, said flow control device having a first member engaged with said tubing string and a second member moveable with respect to said first member and acting cooperatively with said first member for controlling the downhole flow through said flow control device;

b. an actuator for driving said second member;

c. an optical position sensing system acting cooperatively with said first member and said second member for detecting a position of said second member relative to said first member and generating a signal related thereto, wherein said optical position sensing system comprises;

i. an optical fiber disposed in said first member;

ii. a light source for injecting a broadband light signal into said optical fiber;

iii. a plurality of optical elements disposed alone the optical fiber at predetermined positions for reflecting at least a portion of said broadband light signal, each of said optical elements reflecting an optical signal at a different predetermined optical wavelength from any other of said elements;

iv. a plurality of corresponding microbend elements disposed proximate said optical elements and acting cooperatively with said second member to change an optical transmission characteristic of interest of said optical fiber when said second member actuates at least one of said microbend elements;

v. a spectral analyzer for detecting the optical transmission characteristic of interest of said reflected optical signals and generating an analyzer signal in response thereto; and d. a controller receiving said signal and determining, according to programmed instructions, the position of the second member relative to the first member, and driving said actuator to position said second member at a predetermined position for controlling said downhole flow.

2. The system of claim 1, wherein the controller comprises;

i. circuitry for interfacing with and controlling an optical sensor, ii. circuitry for interfacing with and driving said actuator; and iii. a microprocessor for acting according to programmed instructions.

3. The system of claim 1, wherein the plurality of microbend elements are mechanically actuated.

4. The system of claim 1, wherein the plurality of microbend elements are magnetically actuated.

5. The system of claim 1, wherein the optical transmission characteristic of interest of said optical signal comprises at least one of (i) optical power of said reflected optical signal, (ii) wavelength of said reflected optical signal, and (iii) time of flight of said optical signal.

6. The system of claim 1, wherein the well comprises one of (i) a production well and (ii) an injection well.

7. The system of claim 1, wherein the plurality of optical elements comprise Bragg gratings.

8. The system of claim 1, wherein the actuator comprises at least one of (i) a hydraulic actuator and (ii) an electromechanical actuator.

9. The system of claim 1, wherein the controller is located at one of (i) a surface location and (ii) a downhole location.

10. A system for controlling a downhole flow, comprising;

a. a flow control device in a tubing string in a well, said flow control device having a first member engaged with said tubing string and a second member moveable with respect to said first member and acting cooperatively with said first member for controlling the downhole flow through said flow control device;

b. an actuator for driving said second member;

c. an optical position sensing system acting cooperatively with said first member and said second member for detecting a position of said second member relative to said first member and generating a signal related thereto, said optical position sensing system comprising;

i. a predetermined pattern of position encoding marks disposed on a surface of the second member, said pattern adapted to provide a position indication of said second member;

ii. an optical sensor disposed in the first member for sensing said pattern of position encoding marks and generating a signal related thereto; and d. a controller having a microprocessor, the controller receiving said signal and determining, according to programmed instructions, the position of the second member relative to the first member, and driving said actuator to position said second member at a predetermined position for controlling said downhole flow.

11. The system of claim 10, wherein the controller further comprises;

i. circuitry for interfacing with and controlling said optical sensor; and ii. circuitry for interfacing with and driving said actuator.

12. The system of claim 10, wherein the predetermined pattern of position encoding marks disposed on a surface of the second member comprises an optical grating comprising a pattern of lines such that the spacing between adjacent lines is related to axial location along said flow control member.

13. A sensing system for use in a downhole tool, comprising;

a. a flow control device in a tubing string in a well, said flow control device having a first member engaged with said tubing string and second member moveable with respect to said first member and acting cooperatively with said first member for controlling a downhole flow through said flow control device;

b. an optical position sensing system acting cooperatively with said first member and said second member for detecting a position of said second member relative to said first member and generating a signal related thereto, said optical position sensing system comprising;

i. an optical fiber disposed in said first member, ii. a light source for injecting a broadband light signal into said optical fiber;

iii. a plurality of optical elements disposed along the optical fiber at predetermined positions for reflecting at least a portion of said broadband light signal, each of said optical elements reflecting an optical signal at a different predetermined optical wavelength from any other of said elements;

iv. a plurality of corresponding microbend elements disposed proximate said optical elements and acting cooperatively with said second member to change an optical transmission characteristic of said optical fiber when said second member actuates at least one of said microbend elements;

v. a spectral analyzer for detecting an optical transmission characteristic of interest of said reflected optical signals and generating an analyzer signal in response thereto; and c. a controller receiving said signal and determining, according to programmed instructions, the position of the second member relative to the first member.

14. The system of claim 13, wherein the controller comprises;

i. circuitry for interfacing with and controlling said optical position sensing system, ii. circuitry for interfacing with and driving an actuator engaged with the second member; and iii. a microprocessor for acting according to programmed instructions.

15. The system of claim 13, wherein the plurality of microbend elements are mechanically actuated.

16. The system of claim 13, wherein the plurality of microbend elements are magnetically actuated.

17. The system of claim 13, wherein the at least one optical transmission characteristic of interest of said optical signal comprises at least one of (i) optical power of said reflected optical signal, (ii) wavelength of said reflected optical signal, and (iii) time of flight of said optical signal.

18. The system of claim 13, wherein the well comprises one of (i) a production well and (ii) an injection well.

19. The system of claim 13, wherein the plurality of optical elements comprise Bragg gratings.

20. The system of claim 13, further comprising an actuator wherein the actuator comprises at least one of (i) a hydraulic actuator and (ii) an electromechanical actuator.

21. The system of claim 13, wherein the controller is located at one of (i) a surface location and (ii) a downhole location.

22. A sensing system for use in a downhole tool, comprising;

a. a flow control device in a tubing string in a well, said flow control device having a first member engaged with said tubing string and second member moveable with respect to said first member and acting cooperatively with said first member for controlling a downhole flow trough said flow control device;

b. an optical position sensing system acting cooperatively with said first member and said second member for detecting a position of said second member relative to said first member and generating a signal related thereto, said optical position sensing system comprising;

i. a predetermined pattern of position encoding marks disposed on a surface of the second member, said pattern adapted to provide a position indication of said second member;

ii. an optical sensor disposed in the first member for sensing said pattern of position encoding marks and generating a signal related thereto; and c. a controller having a microprocessor, the controller receiving the signal and determining, according to programmed instructions, the position of the second member relative to the first member for controlling the downhole flow.

23. The system of claim 22, wherein the controller further comprises;

i. circuitry for interfacing with and controlling said optical sensor; and ii. circuitry for interfacing with and driving an actuator engaged with the second member.

24. The system of claim 22, wherein the predetermined pattern of position encoding marks disposed on a surface of the second member comprises an optical grating comprising a pattern of lines such that the spacing between adjacent lines is related to axial location along said flow control member.

25. A method for controlling a downhole flow, comprising;

a. extending a flow control device in a tubing siring in a well, said flow control device having a first member engaged with said tubing string and second member moveable with respect to said first member and acting cooperatively with said first member for controlling the downhole flow through said flow control device;

b. providing an actuator for driving said second member;

c. detecting a position of said second member relative to said first member and generating a signal related thereto using an optical position sensing system acting cooperatively with said first member and said second member, the optical position sensing system comprising;

i. an optical fiber disposed in the first member;

ii. a light source for injecting a broadband light signal into said optical fiber;

iii. a plurality of optical elements disposed along the optical fiber at predetermined positions for reflecting at least a portion of said broadband light signal, each of said optical elements reflecting an optical signal at a different predetermined optical wavelength from any other of said elements;

iv. a plurality of corresponding microbend elements disposed proximate said optical elements and acting cooperatively with said second member to change an optical transmission characteristic of said optical fiber when said second member actuates at least one of said microbend elements;

v. a spectral analyzer for detecting an optical transmission characteristic of interest of said reflected optical signals and generating an analyzer signal in response thereto; and d. providing a controller receiving said signal and determining, according to programmed instructions, the position of the second member relative to the first member, and driving said actuator to position said second member at a predetermined position for controlling said downhole flow.

26. The method of claim 25, wherein the controller comprises;

i. circuitry for interfacing with and controlling said optical sensor, ii. circuitry for interfacing with and driving said actuator; and iii. a microprocessor for acting according to programmed instructions.

27. The method of claim 25, wherein the plurality of microbend elements are mechanically actuated.

28. The method of claim 25, wherein the plurality of microbend elements are magnetically actuated.

29. The method of claim 25, wherein the optical transmission characteristic of interest of said optical signal comprises at least one of (i) optical power of said reflected optical signal, (ii) wavelength of said reflected optical signal, and (iii) time of flight of said optical signal.

30. The method of claim 25, wherein the well comprises one of (i) a production well and (ii) an injection well.

31. The method of claim 25, wherein the predetermined pattern of position encoding marks disposed on a surface of the second member comprises an optical grating comprising a pattern of lines such that the spacing between adjacent lines is related to axial location along said flow control member.

32. The method of claim 25, wherein the plurality of optical elements comprise Bragg gratings.

33. The method of claim 25, wherein the actuator comprises at least one of (i) a hydraulic actuator and (ii) an electromechanical actuator.

34. The method of claim 25, wherein the controller is located at one of (i) a surface location and (ii) a downhole location.

35. A method for controlling a downhole flow, comprising;

a. extending a flow control device in a tubing string in a well, said flow control device having a first member engaged with said tubing siring and second member moveable with respect to said first member and acting cooperatively with said first member for controlling the downhole flow through said flow control device;

b. providing an actuator for driving said second member;

c. detecting a position of said second member relative to said first member and generating a signal related thereto using an optical position sensing system acting cooperatively with said first member and said second member, said optical position sensing system comprising;

i. a predetermined pattern of position encoding marks disposed on a surface of the second member, said pattern adapted to provide a position indication of said second member;

ii. an optical sensor disposed in the first member for sensing said pattern of position encoding marks and generating the signal related thereto; and d. providing a controller having a microprocessor, the controller receiving said signal and determining, according to programmed instructions, the position of the second member relative to the first member, and driving said actuator to position said second member at a predetermined position for controlling said downhole flow.

36. The method of claim 35, wherein the controller further comprises;

i. circuitry for interfacing with and controlling said optical sensor; and ii. circuitry for interfacing with and driving said actuator.

37. A system for controlling a downhole flow, comprising;

a. a flow control device in a tubing string in a well, said flow control device having a first member engaged with said tubing string and a second member moveable wit respect to said first member and acting cooperatively with said first member for controlling the downhole flow through said flow control device;

b. an optical fiber disposed in said first member; and c. a plurality of microbend elements disposed along the optical fiber, the plurality of microbend elements acting cooperatively wit said second member to change an optical transmission characteristic of interest of said optical fiber when said second member actuates at least one of said microbend elements, wherein the optical transmission characteristic of interest is related to the position of the second element with respect to the first element.

38. A method for controlling a downhole flow, comprising;

a. extending a flow control device in a tubing string in a well, said flow control device having a first member engaged with said tubing string and second member moveable with respect to said first member and acting cooperatively with said first member for controlling the downhole flow trough said flow control device;

b. disposing an optical fiber in the first member; and c. disposing a plurality of microbend elements along the optical fiber, the plurality of microbend elements acting cooperatively with said second member to alter an optical transmission characteristic of said optical fiber when said second member actuates at least one of said microbend elements, wherein the optical transmission characteristic of interest is related to the position of the second element with respect to the first element.

* * * * *